United States Patent [19]

Gooding

[11] 4,303,402

[45] Dec. 1, 1981

[54] PADDLE

[76] Inventor: Thomas L. Gooding, Rte. #2 Box 1184, Wild Rose, Wis. 54984

[21] Appl. No.: 114,105

[22] Filed: Jan. 17, 1980

[51] Int. Cl.[3] ..... B63H 16/04

[52] U.S. Cl. ..... 440/101; 416/74

[58] Field of Search ..... 440/101, 102, 103; 416/69, 70 R, 74

[56] References Cited

U.S. PATENT DOCUMENTS 560,980 5/1896 Dunlap ..... 416/74
4,061,106 12/1977 Ware ..... 440/101

FOREIGN PATENT DOCUMENTS 2424016 11/1975 Fed. Rep. of Germany ..... 440/101
1308605 2/1973 United Kingdom ..... 440/101
1339719 5/1973 United Kingdom ..... 440/101

*Primary Examiner*—Richard A. Bertsch
*Attorney, Agent, or Firm*—Harvey B. Jacobson

[57] ABSTRACT

A strong, lightweight paddle for manually propelling a water craft with increased stroke efficiency comprises a cupped-shaped blade formed of a foam injected plastic, the blade being angularly displaced from the shaft of the paddle, the shaft is hollow and formed of a lightweight metal such as aluminum or a foam injected plastic. The shaft which is of a hexagonal shape includes a T-shaped handle member. The shape and construction of the paddle enables the paddle to be made shorter than conventional paddles but enables the paddle to maintain and even increase stroke efficiency.

4 Claims, 4 Drawing Figures

PADDLE

BACKGROUND OF THE INVENTION

1. Field of the Invention

The present invention relates to improvements in paddles and oars.

In the manufacture of paddles and oars, it is particularly desirable that they be light and at the same time very strong. This invention provides for a paddle made of lightweight synthetic and metal materials which also provide the paddle with strength and durability. The blade of the paddle is of a unique design and construction and is angularly displaced from the shaft of the paddle so as to provide increased stroke efficiency even though the paddle of the invention is lighter in weight and can be made shorter in length than conventional paddles manufactured.

2. Disclosure Statement

There are numerous paddle designs and construction known, such as U.S. Pat. No. 1,807,289, issued May, 1931 to Herring, which shows a blade comprising a shallow, bowl-type structure, and U.S. Pat. No. 1,263,411, issued to Haskell, which discloses a laminated paddle construction. Phillips in U.S. Pat. Nos. 3,970,032 and 4,133,285 discloses a paddle construction including a T-shaped handle which may be rotated to vary the pitch of the blade member with respect to the handle member. Schmitt in U.S. Pat. No. 2,578,208, issued December, 1951, discloses a spoon in which the handle of the spoon is angled with respect to the bowl portion. None of these references discloses the unique design and construction of the paddle of the present invention.

SUMMARY OF THE INVENTION

Paddle construction typically includes blade, shaft, and handle components. The paddle of the present invention includes a unique web-shaped cupped blade, a hollow hexagonal-shaped shaft, and T-grip handle. The geometric shape of the shaft and T-grip handle enables the paddle to be easily placed and comfortably held in the hands of the user. An advantageous feature of the invention is that the blade is angularly displaced from the longitudinal plane of the shaft to provide for increased stroke efficiency over conventional paddle designs. The unique shape and angular displacement of the blade in the paddle of the present invention enables the paddle length to be shorter than conventional paddles and yet maintain and even increase stroke efficiency.

The materials of construction of the paddle are chosen to provide lightweight and durability to the paddle. The blade of the paddle is preferably formed from a foam injected plastic. The shaft and handle can also be formed of foam injected plastic or a lightweight metal such as aluminum.

Accordingly, it is an object of the present invention to provide an improved paddle which is light in weight, strong and durable.

Another object is to provide an improved paddle which is of such construction and design so as to provide increased propulsion efficiency over conventional paddles.

A further object is to provide an improved paddle design which enables a shorter paddle than that conventionally used to propel a water craft without decreasing stroke efficiency.

A still further object is to provide an improved paddle which can be placed easily and be maintained comfortably in the hand of a user.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
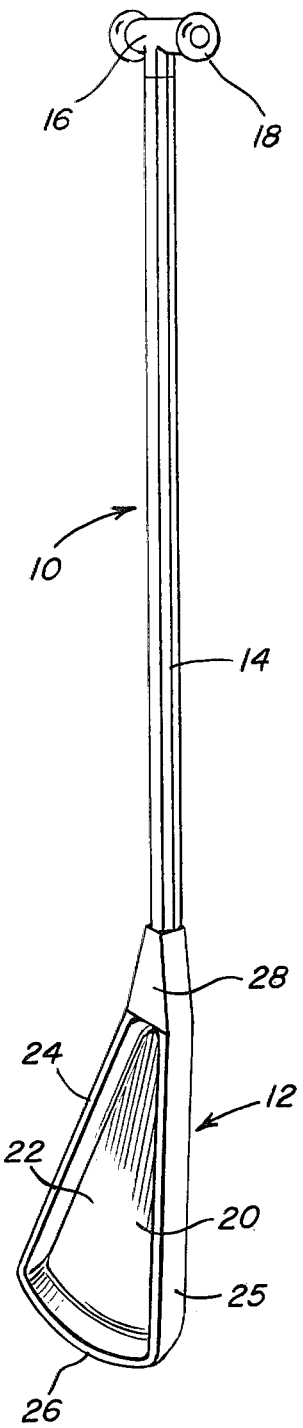
FIG. 1 is a perspective view illustrating the paddle of the present invention.
Figure 2:
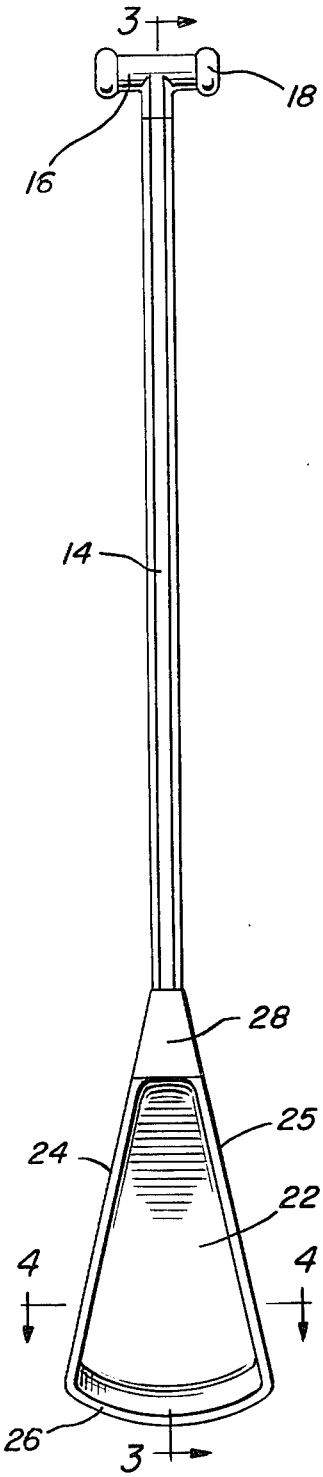
FIG. 2 is a front elevational view of the paddle of this invention.
Figure 4:
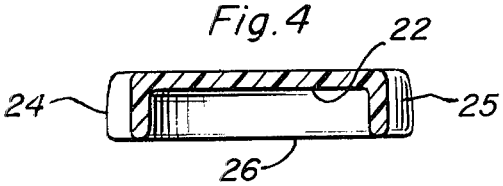
FIG. 4 is a transverse sectional view of the blade of the paddle taken along line 4—4 of FIG. 2.

FIG. 1 illustrates paddle 10 of the present invention including the usual paddle components blade 12, shaft 14, and a grip or handle 16. A unique and advantageous feature of the invention resides in placement of blade 12 with respect to shaft 14. Blade 12 is angularly displaced from shaft 14 to provide increased stroke efficiency over paddles of conventional design. Shaft 14 is hollow and of a hexagonal cross-sectional shape which enables it to be made lighter and stronger than typical shafts of round or oval construction. At the end of shaft 14 is a hollow handle 16, a T-shaped handle including end caps 18 covering each open end. As shown in FIGS. 1 and 2, blade 12 contains a cupped portion 20 of web shape. The cupped portion 20 of blade 12 includes flat bottom surface 22, side wall portions 24 and 25 which are substantially perpendicular to bottom surface 22 and front lip 26 sloped away from bottom surface 22 in the same direction as wall portions 24 and 25. The slope of front lip 26 is of an angle that is substantially less than perpendicular enabling water to easily escape cupped portion 20 of blade 12 and thus promotes the increased stroke efficiency featured by this invention during the stroking of paddle 10 through water. Side wall portions 24 and 25 and front lip 26 of blade 12 form a triangular web shape. Blade 12 further includes portion 28 as a reinforcement positioned between the cupped portion 20 of blade 12 and shaft 14. Reinforcement 28 prevents blade 12 from bending during stroking and thus maintains blade 12 at the formed angle to shaft 14. The cupped portion 20 of blade 12 illustrated in FIG. 4 shows bottom surface 22, substantially perpendicular side walls 24 and 25, and front lip 26 sloped at an angle substantially less than perpendicular with respect to bottom surface 22.

Figure 3:
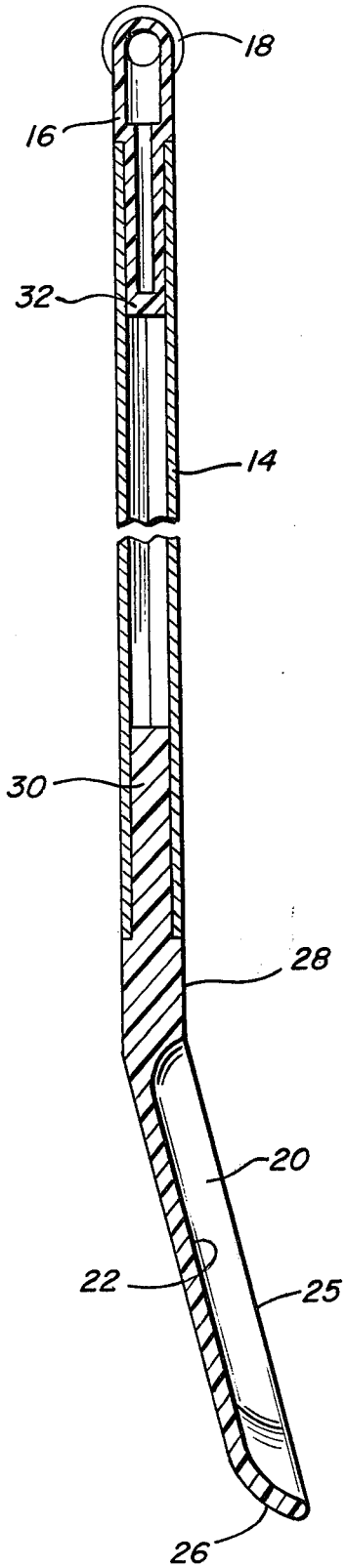
FIG. 3 is an enlarged longitudinal sectional view of the paddle of the present invention showing the angular displacement of the blade member from the plane of the shaft and showing an example of how the component parts of the paddle can be assembled.

The enlarged view of paddle 10 in FIG. 3 illustrates the angular displacement of blade 12 to shaft 14. This Figure also illustrates a typical manner of combining the component parts blade 12, shaft 14, and T-shaped handle 16 of paddle 10 to form a singular unit. The cupped portion 20 of blade 12 is at an angle of about 7°–15° from the longitudinal plane of shaft 14. Reinforcement 28 is a unitary extension of cupped portion 20 and maintains the angular displacement of blade 12 relative to the shaft during the stroke movement of paddle 10 through water. The angular displacement of blade 12 with shaft 14 provides for substantially increased propulsion efficiency over conventional paddles of the same length. The web shape of cupped portion 20 of blade 12 formed by flat bottom surface 22, perpendicular side walls 24 and 25, and sloped front lip 26 also adds to the increased propulsion efficiency of the paddle 10 over conventional paddle designs. One manner in which the components of paddle 10 can be formed into a singular unit is shown in FIG. 3. Blade 12 includes integral extension 30 which is inserted in an end of hollow shaft 14 while hollow handle 16 includes hollow extension member 32 which is inserted inside shaft 14 at an end opposite to that containing blade 12. End caps 18 cover each open end of T-shaped handle 16. It is to be understood that other known means of connecting the component parts of paddle 10 can be utilized. As an alternative example, shaft 14 could be constructed so as to have a smaller width than a hollow extension of blade 12 and thus the shaft 14 could be inserted into this hollow section. Likewise, the diameter of the shaft 14 could be smaller than the diameter of handle 16 and inserted therein. Further, blade member 12, shaft 14, and handle 16 may even include synchronized threaded portions and the components fastened as screw-like members.

The materials of construction utilized in the present invention are unique to paddle design and provide paddle 10 with lightweight, strength and durability. The materials for manufacture of paddle 10 are synthetic plastics, foam injected plastics, and lightweight metals such as aluminum. A preferred construction of paddle 10 includes blade 12 formed of injected plastic foam, shaft 14 constructed of aluminum or injected foam plastic, and handle 16 formed of an acrylic-butadiene-styrene copolymer and end caps 18 also of a plastic material. It is to be understood that any known plastic material can be used in the construction of paddle 10. The foam injected plastic materials provide a preferred embodiment of the invention since they are lightweight and durable. Further, it is now possible to form blade 12, shaft 14, and even handle 16 of a unitary construction utilizing these foam materials, providing increased strength since no joints or connections would have to be formed in the unitary construction. The formation of paddle 10 from its component parts as shown in FIG. 3 lends itself to be decorated in a pleasing manner. For example, blade 12 and T-shaped handle 16 can be colored or dyed with one color while shaft 14 and end caps 18 are colored or dyed with a single contrasting color.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A paddle for propelling a water craft, said paddle comprising a blade, a straight shaft connected to said blade, and a handle placed on said shaft at an end opposite from said blade, said blade being angularly displaced from the longitudinal axis of said shaft at an angle of about 7° to about 15°, said blade comprising a cup portion including a flat bottom of triangular web-shape, two side walls substantially perpendicular to said bottom and a front lip portion connecting said side walls, said front lip portion being sloped away from said bottom, said paddle including a reinforcement portion contiguous with said cup portion and positioned between said cup portion and said shaft, said reinforcement portion being in a plane parallel to said shaft, said cup portion of said blade being angularly displaced from said shaft, said shaft being hollow and formed of lightweight materials selected from the group consisting of foam injected plastics and lightweight metal and said blade being formed from foam injected plastic.

2. The paddle of claim 1 wherein said shaft is in the shape of a hexagon.

3. The paddle of claim 1 wherein said lightweight metal is aluminum.

4. The paddle of claim 3 wherein said handle is a T-shaped member.

* * * * *